US007988180B2

(12) United States Patent
Holzer et al.

(10) Patent No.: US 7,988,180 B2
(45) Date of Patent: Aug. 2, 2011

(54) SKI BINDING WITH A POSITIONING AND FIXING MECHANISM FOR ITS BINDING PIECE BODIES

(75) Inventors: Helmut Holzer, St. Johann (AT); Erich Rieger, Graz (AT)

(73) Assignee: Atomic Austria GmbH (AT)

( * ) Notice: Subject to any disclaimer, the term of this patent is extended or adjusted under 35 U.S.C. 154(b) by 3 days.

(21) Appl. No.: 12/610,547

(22) Filed: Nov. 2, 2009

(65) Prior Publication Data

US 2010/0109290 A1 May 6, 2010

(30) Foreign Application Priority Data

Nov. 3, 2008 (AT) ..... GM630/2008 U

(51) Int. Cl.
*A63C 9/00* (2006.01)

(52) U.S. Cl. ..... 280/616; 280/618; 280/611

(58) Field of Classification Search ..... 280/611, 280/612, 613, 616, 617, 618, 623, 626, 631, 280/632, 633, 634, 636
See application file for complete search history.

(56) References Cited

U.S. PATENT DOCUMENTS

| | | | | | |
|---|---|---|---|---|---|
| 3,614,117 | A | * | 10/1971 | Iizuka | 280/633 |
| 3,831,956 | A | * | 8/1974 | Earl | 280/636 |
| 3,874,685 | A | * | 4/1975 | Von Besser | 280/618 |
| 3,876,218 | A | * | 4/1975 | Von Besser | 280/618 |
| 3,897,076 | A | * | 7/1975 | Beyl | 280/634 |
| 3,984,124 | A | * | 10/1976 | Gertsch | 280/618 |
| 4,023,824 | A | * | 5/1977 | von Besser | 280/618 |
| 4,063,752 | A | * | 12/1977 | Whitaker et al. | 280/624 |
| 4,065,151 | A | * | 12/1977 | Weinstein et al. | 280/618 |
| 4,145,071 | A | * | 3/1979 | Salomon | 280/624 |
| 4,157,193 | A | * | 6/1979 | Beyl | 280/633 |
| 4,190,264 | A | * | 2/1980 | Himmetsberger et al. | 280/618 |
| 4,203,614 | A | * | 5/1980 | Marker | 280/637 |
| 4,310,170 | A | * | 1/1982 | Linecker | 280/636 |
| 4,441,733 | A | * | 4/1984 | Spitaler | 280/633 |
| 4,600,213 | A | * | 7/1986 | Sedlmair et al. | 280/618 |
| 4,674,766 | A | * | 6/1987 | Ramer | 280/614 |
| RE33,350 | E | * | 9/1990 | Whitaker et al. | 280/624 |
| 4,955,633 | A | * | 9/1990 | Stritzl et al. | 280/633 |
| 4,957,305 | A | * | 9/1990 | Freisinger et al. | 280/618 |
| 4,997,199 | A | * | 3/1991 | Horn | 280/618 |
| 5,056,808 | A | * | 10/1991 | Klaus et al. | 280/617 |
| 5,056,809 | A | * | 10/1991 | Brischoux et al. | 280/617 |

(Continued)

FOREIGN PATENT DOCUMENTS

AT 411735 5/2004

(Continued)

*Primary Examiner* — Jeffrey J Restifo
*Assistant Examiner* — Brodie Follman
(74) *Attorney, Agent, or Firm* — Lerner, David, Littenberg, Krumholz & Mentlik, LLP

(57) ABSTRACT

The invention describes a ski binding with guide elements for a front and a rear binding piece body oriented in the binding longitudinal direction, which binding piece bodies are designed to retain the front and rear end portion of a sports shoe. This ski binding comprises a first coupling element connected to the front binding piece body and a second coupling element connected to the rear binding piece body. A positioning and fixing mechanism is disposed between the binding piece bodies in order to adjust and retain the binding piece bodies by reference to the binding longitudinal direction. The first and second coupling element can be selectively rigidly coupled with one another and uncoupled from one another.

13 Claims, 5 Drawing Sheets

U.S. PATENT DOCUMENTS

| | | | | | |
|---|---|---|---|---|---|
| 5,085,453 | A * | 2/1992 | Bildner | 280/612 |
| 5,114,173 | A * | 5/1992 | Goud et al. | 280/633 |
| 5,222,756 | A * | 6/1993 | Gorza | 280/616 |
| 5,261,688 | A * | 11/1993 | Rohrmoser | 280/617 |
| 5,324,062 | A * | 6/1994 | Rigal et al. | 280/605 |
| 5,344,178 | A * | 9/1994 | Rohrmoser | 280/617 |
| 5,344,179 | A * | 9/1994 | Fritschi et al. | 280/618 |
| 5,344,180 | A * | 9/1994 | Lancon et al. | 280/625 |
| 5,348,335 | A * | 9/1994 | Dasarmaux et al. | 280/633 |
| 5,913,532 | A * | 6/1999 | Viodet et al. | 280/633 |
| 5,975,555 | A * | 11/1999 | Lehner et al. | 280/618 |
| 6,050,591 | A * | 4/2000 | Bardin et al. | 280/633 |
| 6,065,895 | A * | 5/2000 | Lehner et al. | 403/105 |
| 6,073,955 | A * | 6/2000 | Chonier | 280/605 |
| 6,092,829 | A * | 7/2000 | Mercier | 280/617 |
| 6,203,052 | B1 * | 3/2001 | Dodge | 280/624 |
| 6,217,055 | B1 * | 4/2001 | Silva | 280/607 |
| 6,227,558 | B1 * | 5/2001 | Arduin et al. | 280/611 |
| 6,471,235 | B1 * | 10/2002 | Luitz et al. | 280/618 |
| 6,676,151 | B2 * | 1/2004 | Mangold et al. | 280/602 |
| 6,814,367 | B2 * | 11/2004 | Mercier et al. | 280/613 |
| 6,824,158 | B1 * | 11/2004 | Keller et al. | 280/618 |
| 6,848,704 | B2 * | 2/2005 | Lucas | 280/613 |
| 6,935,651 | B2 * | 8/2005 | Krumbeck et al. | 280/616 |
| 6,951,347 | B2 * | 10/2005 | Buquet et al. | 280/625 |
| 6,964,428 | B2 * | 11/2005 | Quellais et al. | 280/615 |
| 6,986,526 | B2 * | 1/2006 | Haughlin | 280/613 |
| 7,036,842 | B2 * | 5/2006 | Krumbeck et al. | 280/618 |
| 7,063,345 | B2 * | 6/2006 | Holzer | 280/611 |
| 7,207,591 | B2 * | 4/2007 | Riedel et al. | 280/614 |
| 7,275,757 | B2 * | 10/2007 | Hoesl et al. | 280/617 |
| 7,393,000 | B2 * | 7/2008 | Resch et al. | 280/604 |
| 7,393,002 | B2 * | 7/2008 | Thomas et al. | 280/613 |
| 7,448,641 | B2 * | 11/2008 | Buquet et al. | 280/607 |
| 7,451,997 | B2 * | 11/2008 | Hauglin | 280/618 |
| 7,510,207 | B2 * | 3/2009 | Resch et al. | 280/617 |
| 7,513,509 | B2 * | 4/2009 | Guyot et al. | 280/11.14 |
| 7,571,923 | B2 * | 8/2009 | Baumgartner et al. | 280/611 |
| 7,681,905 | B2 * | 3/2010 | Hauglin | 280/615 |
| 7,744,113 | B2 * | 6/2010 | Farges | 280/618 |
| 7,802,808 | B2 * | 9/2010 | Neiley | 280/623 |
| 7,828,303 | B2 * | 11/2010 | Girard et al. | 280/11.3 |
| 7,832,754 | B2 * | 11/2010 | Girard et al. | 280/615 |
| 2001/0002747 | A1 * | 6/2001 | Gignoux et al. | 280/615 |
| 2002/0101060 | A1 * | 8/2002 | Gorza et al. | 280/611 |
| 2002/0105167 | A1 * | 8/2002 | Mercier et al. | 280/613 |
| 2003/0001363 | A1 * | 1/2003 | Battistella et al. | 280/618 |
| 2003/0098570 | A1 * | 5/2003 | Ayliffe | 280/624 |
| 2003/0116942 | A1 * | 6/2003 | Derisoud et al. | 280/623 |
| 2003/0151230 | A1 * | 8/2003 | Lucas | 280/613 |
| 2003/0193171 | A1 * | 10/2003 | Krumbeck et al. | 280/616 |
| 2003/0209881 | A1 * | 11/2003 | Krumbeck et al. | 280/623 |
| 2004/0056451 | A1 * | 3/2004 | Baikhardt | 280/618 |
| 2004/0145153 | A1 * | 7/2004 | Holzer | 280/611 |
| 2004/0145154 | A1 * | 7/2004 | Holzer | 280/611 |
| 2005/0212262 | A1 * | 9/2005 | Hoesl et al. | 280/611 |
| 2006/0214393 | A1 * | 9/2006 | Dodge | 280/611 |
| 2007/0063484 | A1 * | 3/2007 | Baumgartner et al. | 280/616 |
| 2007/0090627 | A1 * | 4/2007 | Laurent | 280/612 |
| 2007/0102899 | A1 * | 5/2007 | Schaidreiter | 280/617 |
| 2007/0126205 | A1 * | 6/2007 | Resch et al. | 280/617 |
| 2007/0145720 | A1 * | 6/2007 | Resch et al. | 280/607 |
| 2008/0088114 | A1 * | 4/2008 | Farges | 280/617 |
| 2008/0150256 | A1 * | 6/2008 | Girard et al. | 280/612 |
| 2008/0191450 | A1 * | 8/2008 | Girard et al. | 280/617 |
| 2009/0194971 | A1 * | 8/2009 | Ettlinger et al. | 280/617 |

FOREIGN PATENT DOCUMENTS

| | | | |
|---|---|---|---|
| AT | 412840 | | 8/2005 |
| AU | 2003251701 | A1 | 2/2005 |
| DE | 3523058 | A1 | 1/1987 |
| DE | 4135899 | A1 | 6/1992 |
| DE | 10039816 | A1 | 3/2001 |
| DE | 10220483 | A1 | 11/2003 |
| DE | 4143662 | B4 | 2/2004 |
| DE | 10253574 | A1 | 5/2004 |
| DE | 10334840 | A1 | 11/2004 |
| DE | 102004061589 | A1 | 9/2005 |
| DE | 102004048768 | A1 | 4/2006 |
| DE | 102006031993 | A1 | 3/2007 |
| DE | 102006039988 | A1 | 2/2008 |
| EP | 1419805 | A1 | 5/2004 |
| EP | 1645310 | A1 | 4/2006 |
| EP | 1764138 | A1 | 3/2007 |
| WO | 2005014124 | A1 | 2/2005 |

* cited by examiner

SKI BINDING WITH A POSITIONING AND FIXING MECHANISM FOR ITS BINDING PIECE BODIES

BACKGROUND OF THE INVENTION

The invention relates to a ski binding with guide elements oriented in the binding longitudinal direction which can be pre-fitted or fitted on a ski for a front and a rear binding piece body, which ski binding enables the distance between the binding piece bodies to be changed as simply and rapidly as possible resulting in a corresponding change in the relative positions of the binding piece bodies with respect to a ski, as defined by the characterising features of claim 1.

For a long time, binding manufacturers, hire businesses and users have been seeking ways of setting a ski binding or adjusting a ski binding to respective shoe sizes rapidly and comfortably. For example, reference may be made to the ski binding disclosed in document DE 35 23 058 A1. It describes a ski binding with an adjusting mechanism disposed in one of the binding piece bodies, in particular in the toe piece, by means of which the entire binding piece unit comprising the two binding piece bodies can be fixed in different positions in the ski longitudinal direction on the one hand and by means of which adjusting mechanism the distance between the binding pieces can also be adapted to the respective shoe size on the other hand. To this end, the heel piece is coupled with the adjusting mechanism in the front piece body via a strip-shaped connecting element to enable the distance to be varied. The disadvantage of this system is that the adjusting mechanism is disposed in the toe piece which increases its size and the operating lever for the adjusting mechanism has to be moved into two different positions in order to be able to vary the distance between the binding pieces or to enable the relative position of the binding unit to be set with respect to the ski. This requires more concentration on the part of the operator or user.

Documents DE 41 35 899 A1 and DE 41 43 662 B4 disclose a ski binding, whereby the two binding piece bodies are accommodated and guided in longitudinal guides in order to retain the toe-side and heel-side end portion of the sports shoe. Disposed between the front and rear binding piece bodies is a length adjusting mechanism for individually setting the binding piece distance. These designs of length adjusting mechanisms permit a coupling based on a defined synchronous motion between two strip-shaped coupling elements with respect to the binding piece bodies or, alternatively enable the binding piece bodies to be moved separately from one another. A longitudinal positioning mechanism for this central length adjusting mechanism positions the length adjusting mechanism in at least one relative position with respect to the ski longitudinal direction. Most of the described embodiments have strip-shaped coupling elements between the two binding piece bodies, which are disposed lying next to one another by reference to the standing plane for a sports shoe. Various synchronous adjusting and locking mechanisms are disposed between these mutually spaced apart, adjacently positioned coupling elements. The embodiment illustrated in FIGS. 11, 12 shows a variant relating to how a strip-shaped connecting element is secured or locked and comprises a functional element of the longitudinal positioning mechanism for the centrally disposed length adjusting mechanism. The embodiment illustrated in FIG. 18 relates to a locking mechanism for a separate coupling element. In this instance, an intermediate piece or a middle part-portion of one of the two coupling elements is provided in the form of a toothed rack with lateral toothing, which can be moved into and out of engagement with laterally disposed, spring-biased lock members to enable the co-operating coupling element—and hence also the respective binding piece body—to move longitudinally so that it can be locked and released. FIG. 20 illustrates a locking mechanism similar to that illustrated in FIG. 18 but with a locking mechanism comprising a spring-biased lock member co-operating with each of the two adjacently lying coupling elements, and each of these locking mechanisms can be operated separately from one another. The spring force acting on the individual lock members is applied by means of compression springs, in particular helical springs, the spring force of which forces the lock members into the locked position with the respective co-operating coupling element and which spring force is responsible for maintaining the blocked or locked position of the lock members. These known designs are relatively complex and relatively cost-intensive due to the large number of components needed and are therefore only satisfactory under certain conditions.

Ski bindings based on a design where the distance between the binding pieces can be individually varied by means of a positioning and fixing mechanism disposed between the binding piece bodies and where the strip-shaped coupling elements for the binding piece bodies are disposed adjacent to one another by reference to the standing plane for a sports shoe are disclosed in documents AT 411 735 B, DE 102 20 483 A1, DE 102 53 574 A1, WO 2005/014124 A1, DE 103 34 840 A1, DE 10 2004 048 768 A1, or EP 1 764 138 A1. Similar ski bindings to these with adjacently extending coupling elements, where the positioning mechanism for the binding piece bodies is disposed centrally or in the middle but the fixing mechanism for fixing the desired distance between the binding pieces is disposed non-centrally or in a distal end portion of the ski binding, are disclosed in documents DE 10 2004 048 768 A1 or AT 412 840 B.

Documents DE 10 2006 039 988 A1 or DE 10 2004 061 589 A1 disclose ski bindings which can be adjusted to suit different shoe sole lengths, the binding piece bodies of which are each provided with a strip-shaped or plate-shaped coupling element, and the coupling elements are of a fork-shaped or finger-shaped design in their mutually facing end portions and are therefore able to engage with one another in the form of a tine-type connection with a variable overlap width.

Document DE 100 39 816 A1, filed by this applicant, also disclose a ski binding, the binding piece bodies of which can be displaceably retained in longitudinal guides permanently secured to the ski. In this instance, mutually facing strip-shaped coupling elements on each of the two binding piece bodies co-operate with a positioning and fixing mechanism for the coupling elements disposed between the longitudinal guides. Matching, complementary sets of teeth which can be moved into engagement between the two coupling elements extending one above the other are disposed within a variable overlap portion between the two coupling elements, in particular on the mutually facing flat faces of the mutually overlapping coupling elements. These sets of teeth in the mutually overlapping portion of the two coupling elements therefore help to ensure that the distance between the two binding piece bodies is fixed so that slipping is prevented as far as possible. In order to achieve sufficiently small adjustment step widths, fine teeth with small tooth-to-tooth distances are provided. In an alternative embodiment, it is proposed that a one-piece connecting element be provided between the binding piece bodies, and the unit comprising the front binding piece body, one-piece connecting element and rear binding piece body can be positioned in steps by reference to the ski or binding longitudinal direction by means of several orifices in the one-piece connecting element spaced apart from one another in the binding longitudinal direction in combination with a co-operating projection on the central positioning and fixing mechanism. However, the fine teeth needed to obtain small adjustment step widths make it more difficult to adjust the binding piece bodies to the requisite desired positions.

Document DE 10 2006 031 993 A1, likewise filed by this applicant, discloses a ski binding of the generic type based on the introductory part of claim 1. In particular, the ski binding disclosed has coupling elements extending one above the other between the binding piece bodies and a positioning and fixing mechanism for the coupling elements or for the binding piece bodies connected to them in the overlapping portion between the coupling elements. Based on this known embodiment, the positioning elements on the flat faces of the two bar-shaped or strip-shaped coupling elements are provided in the form of an arrangement of rows or lines of orifices or recesses or raised areas on the flat faces of the coupling elements, i.e. in a pattern based on an array. The desired overlap width can be fixed and hence the desired distance between the binding pieces by means of a locking pin which can be moved perpendicular to the flat faces of the coupling elements. To this end, this locking pin is moved selectively so that it establishes a positive connection with one of the positioning elements disposed in a row or array. Although mutual friction between the coupling elements extending one above the other can be reduced using this embodiment, the overall comfort achieved for the user when the positioning and fixing mechanism assumes the position enabling the binding piece bodies to move freely is only partially satisfactory.

BRIEF SUMMARY OF THE INVENTION

The underlying objective of this invention is to propose a ski binding, whereby the distance between the binding piece bodies of the ski binding can be adjusted to suit the respective requirements as rapidly and comfortably as possible but this ski binding is nevertheless designed to guarantee a high degree of operating reliability.

This objective is achieved by the invention due to the fact that the positioning elements of the first and second coupling elements are disposed respectively on the left-hand and/or right-hand side faces of the two coupling elements lying one above the other by reference to the standing plane for a sports shoe and by reference to the binding longitudinal direction, and the first and second coupling element can be selectively rigidly coupled with one another and uncoupled from one another by means of at least one lock element mounted so that it can be displaced essentially perpendicular to a vertical plane extending in the binding longitudinal direction, and the at least one lock element can moved either into a mutual engagement or out of engagement with both the positioning elements of the first coupling element and positioning elements of the second coupling element.

The advantage gained as a result of the design defined in claim 1 resides in the fact that the strip-shaped or bar-shaped coupling elements, which are disposed in the intermediate region between the front and rear binding piece bodies, enable their overlap width and hence the distance between the binding pieces to be changed in the easiest possible way, in spite of the fact that they lie one above the other and partially overlap. In particular, the positioning elements, which are practically designed to obtain a robust and stepped change in the distance between the binding pieces, are advantageously disposed on at least one side face or flank of the two coupling elements lying one above the other, as a result of which these lateral positioning elements of the two coupling elements do not sit in a direct mutual engagement, thereby ensuring that the relative movement between the coupling elements is not impaired within their overlapping portion due to teeth or other positioning elements on the two coupling elements. Another advantage is the fact that the two mutually overlapping coupling elements can be connected to one another and uncoupled form one another, starting from at least one of the two oppositely lying side faces, by means of at least one lock element which can be displaced transversely to the binding longitudinal direction by reference to the binding longitudinal direction. Furthermore, due to the coupling elements disposed one above the other, the points at which force is introduced or the direction of the force can be directed centrally or congruently with respect to the binding longitudinal direction between the central positioning and fixing mechanism and the binding piece bodies. In particular, the directions of the forces between the binding piece bodies and central positioning and fixing mechanism may extend longitudinally at the centre or congruently with the longitudinal mid-axis of the ski binding or ski. Rotating forces or tensile forces extending obliquely with respect to the binding piece bodies of the ski binding can therefore be avoided. In addition, the forces transmitted from the binding piece bodies to the positioning and fixing mechanism disposed centrally or in between extend as far as possible along the longitudinal centre and are oriented as far as possible centrally and parallel with the binding longitudinal axis. By contrast, the at least one lock element for the coupling elements is positioned eccentrically with respect to the binding longitudinal axis and the at least one lock element acts from the side, as it were, on the coupling elements positioned at the longitudinal centre when the lock element establishes a positive connection with at least one common or uniform flank or side face of the two coupling elements. Whatever the circumstances, the desired or requisite distance can be set relatively easily between the binding pieces based on the ski binding proposed by the invention. The specified design is nevertheless relatively robust and the specified positioning and fixing mechanism is capable of withstanding the forces which occur during use of the ski binding with a high degree of reliability.

Another embodiment defined in claim 2 is also of advantage because the robustness of the ski binding and its positioning and fixing mechanism can be even further increased. Specifically due to the clamping or pincer action of the two lock elements on the coupling elements extending in between, the maximum ability of the central fixing mechanism to withstand load can be significantly increased.

The advantage of the design defined in claim 3 is that a relatively finely pitched toothing can be provided, which effortlessly copes with the requisite smallest adjustment step widths of the binding piece bodies but is nevertheless able to withstand the resultant forces reliably. Another advantage of this design resides in the fact that the at least one lock element is able to absorb the sliding forces extending in the binding longitudinal direction which occur between the two overlapping coupling elements without any difficulty because the at least one laterally positioned lock element is subjected to shearing, as a result of which a lock element of a relatively small size or slim dimension is enough to withstand the relative forces occurring between the two coupling elements.

The advantage of the embodiment defined in claim 4 is that the lock element is able to move due to a structurally simple and functionally reliable resilient elastic retention or mounting for the at least one lock element. In particular, such a resilient elastic mounting is not susceptible to jamming, relatively speaking, and the intended movement is still relatively reliable even under adverse conditions of use, in particular due to the effect of snow or ice. Due to the features defined in claim 4, therefore, a relatively insensitive mounting or retention can be obtained for the at least one lock element, and it is possible either to opt for a first embodiment with uncoupled elements or a second embodiment in which the at least one lock element sits in a resiliently elastic flexible, in particular ratchet, engagement with the two coupling elements lying one above the other.

The features defined in claim 5 further enhance the robustness and functional reliability of the positioning and fixing mechanism. In particular, it is also possible to use a leaf spring rather than a coil or helical spring without any problem, even under critical or unfavourable ambient conditions. In particular, the requisite ability of the lock element to move when the positioning and fixing mechanism assumes its position is guaranteed to a high degree. If opting for a central or middle disposition of the lock element on the leaf spring, the risk of excessive strain on the leaf spring is minimised because a defined, limited deflection of the lock element takes place, thereby virtually ruling out excess strain on the leaf spring retained or mounted on its distal ends.

The embodiment defined in claim 6 is also of particular advantage because when the fixing mechanism is inactive, the binding piece bodies can be moved in the lightest possible movement. This makes adjustment more comfortable and optionally also shortens the time needed to make the adjustment overall.

The advantage of the embodiment defined in claim 7 is that a mere pivoting movement of the lock lever enables a rapid change to be made between a situation in which the binding piece bodies can be positioned individually and one in which the desired setting can be reliably fixed or secured. In particular, the locking function of the at least one lock element can be activated and deactivated without the need for tools. Another advantage is the fact that the lock lever operates, depending on the pivot position, so that it fixes the at least one lock element in its locked position and also releases the at least one lock element from the coupling elements.

Also of particular advantage is an embodiment defined in claim 8, because the forces acting on the at least one lock element in the direction of the binding longitudinal axis are absorbed by the lock lever as soon as it has assumed its fixing position. The retaining system or mounting for the at least one lock element may advantageously be based on a relatively flimsy or filigree design as a result, and it is specifically possible to use a spring element, and when the lock lever is switched to its fixing position, the at least one lock element is fixed in a particularly robust manner with respect to the binding longitudinal direction. In other words, the mounting which enables the lock element to move is relatively simple and slim and in particular may be provided in the form of a spring element because the at least one lock element is secured in the active or locking position due to the positive connection between the lock lever and the at least one lock element.

Due to the features defined in claim 9, a positive connection can be obtained between the pivotably mounted lock lever and the at least one lock element that is as far as possible without clearance but nevertheless functions perfectly. In addition, the at least one lock element can be forced against the respective side faces of the first and second coupling elements sufficiently free of clearance to guarantee a reliable positive engagement between these elements.

The advantage of the features defined in claim 10 is that at least one of the lateral leg portions of the lock lever serves as a relatively simple yet robust operating element for fixing and releasing the at least one lock element. In particular, this makes it possible to produce a positioning and fixing mechanism which requires as few components as possible but is reliable and as inexpensive as possible overall.

The features defined in claim 11 make for a particularly stable mounting of the lock lever when it assumes its fixing position. In particular, the forces acting on the lock lever are transmitted directly into the base plate of the positioning and fixing mechanism as soon as the lock lever assumes its fixing position. Moreover, the shaft of the lock lever is relieved of stress because the force is transmitted directly between the base plate and lateral leg portions of the lock lever. The shaft of the lock lever may therefore be provided in the form of a simple pin shaft or a shaft with a relatively small bolt or axial diameter.

The advantage of the embodiment defined in claim 12 is that the lock lever can be retained in its fixing position with a high degree of reliability, thereby preventing it from being undesirably switched into positioning mode. Another advantage resides in the fact that this locking action for the lock lever can be overcome with out tools, in particular by hand, so that the lock lever can be spontaneously switched into the releasing or positioning mode relatively quickly and effortlessly by a conscious action.

As a result of the features defined in claim 13, a snap-fit connection can be obtained that is as inexpensive as possible but functionally reliable. Furthermore, no additional elements are needed to obtain the desired elasticity of the at least one coupling element.

BRIEF DESCRIPTION OF THE DRAWINGS

In order to provide a clearer understanding, the invention will be described in more detail below with reference to the appended drawings.

These provide highly simplified, schematic diagrams as follows.

DETAILED DESCRIPTION

Figure 1:
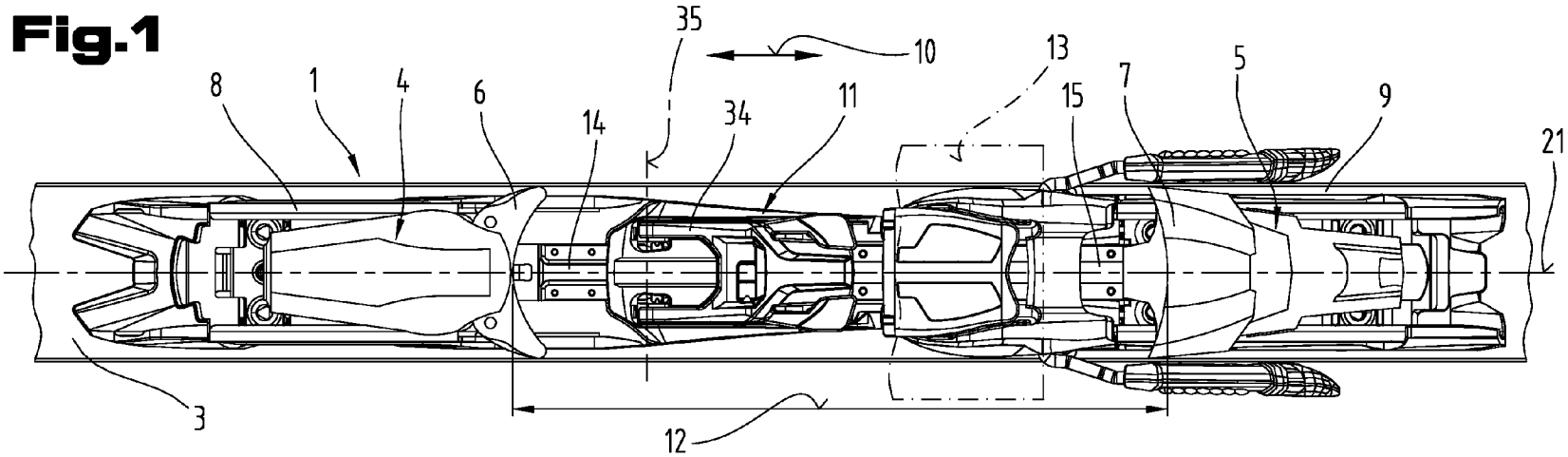
FIG. 1 is a plan view of a ski binding with a positioning and fixing mechanism for the binding piece bodies disposed between the front and rear binding piece bodies.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
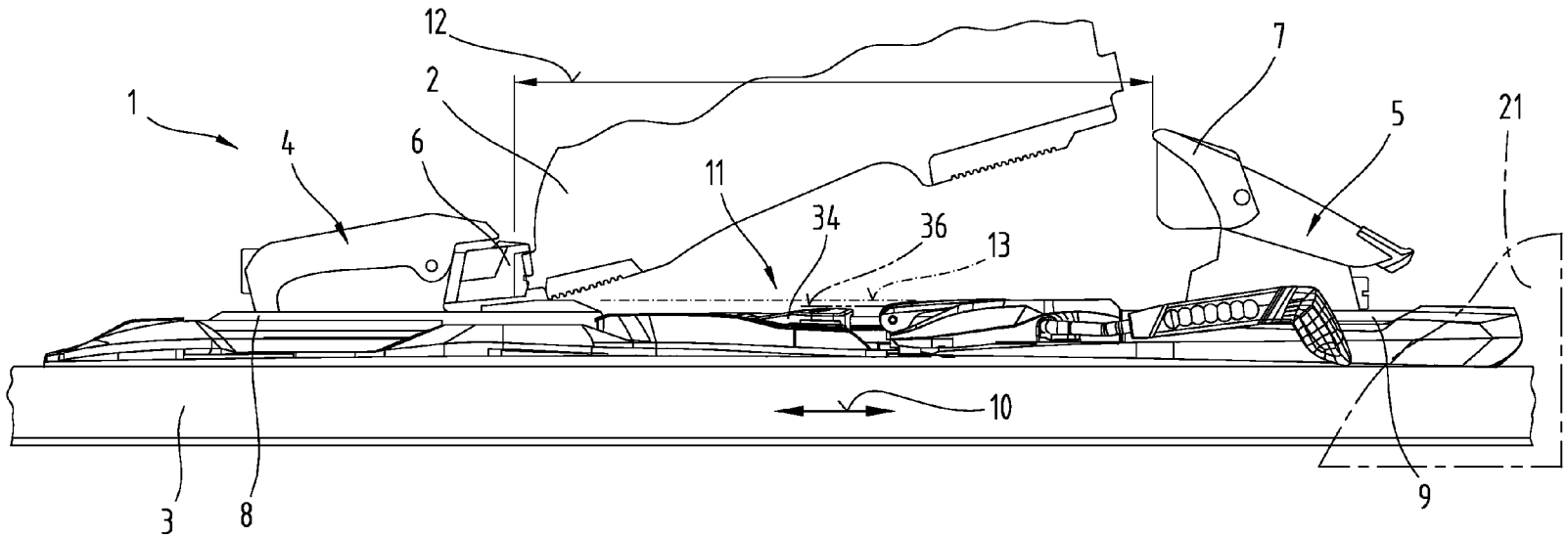
FIG. 2 is a side view of the ski binding illustrated in FIG. 1.
Figure 3:
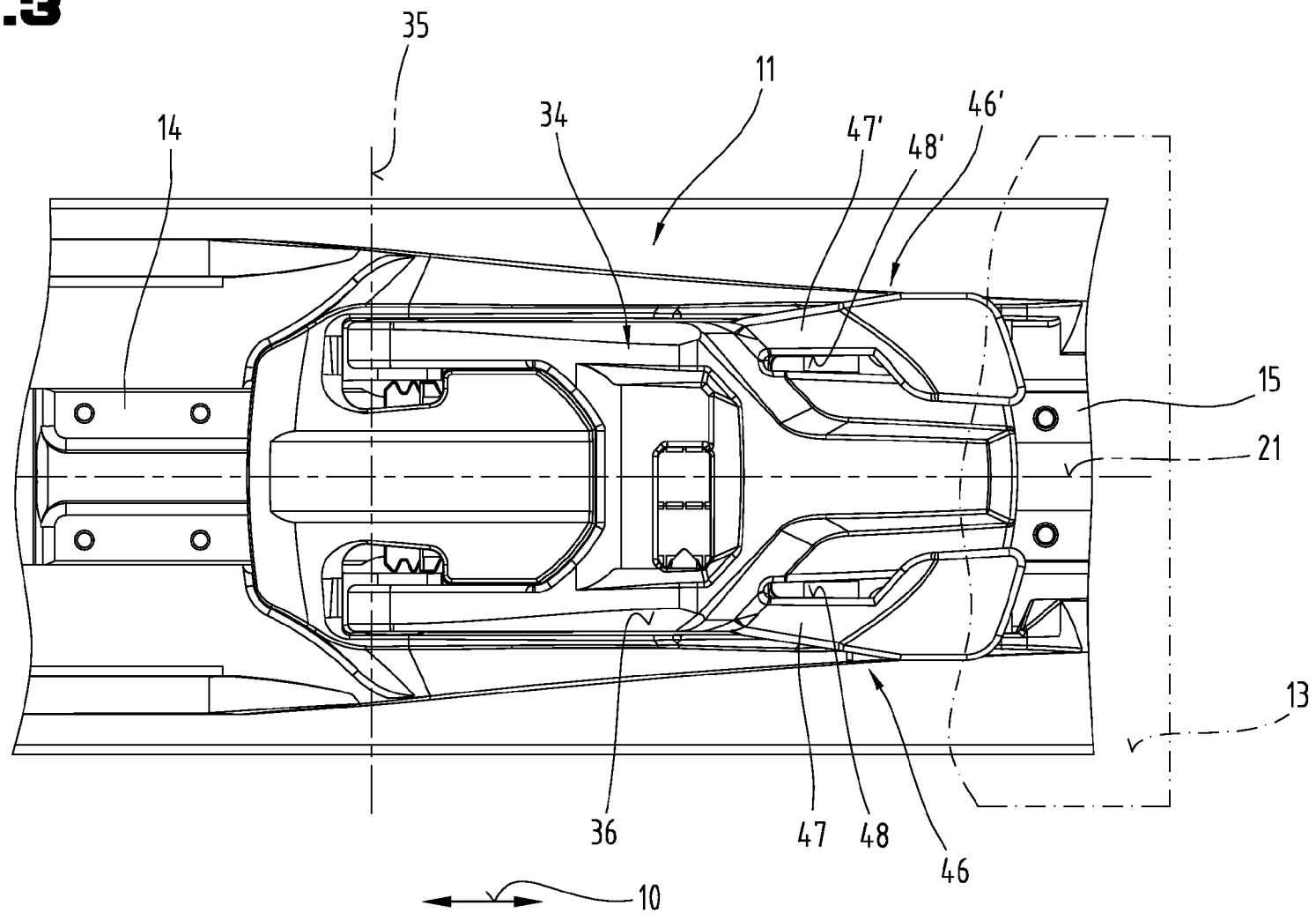
FIG. 3 illustrates an improved positioning and fixing mechanism for the binding piece bodies of a ski binding on assuming the fixing position.

FIGS. 1 and 2 illustrate a ski binding 1, in particular a safety ski binding, for connecting a sports shoe 2 to a board-type gliding device, in particular a ski 3, so that it can be released as and when necessary. If the ski binding 1 is a safety ski binding, the sports shoe 2 can be released from the ski binding 1 and ski 3—in a known manner—if subjected to safety-critical or health-endangering stress. In a manner known per se, the relevant boundary or threshold values for such an automated separation or release of the sports shoe 2 can be set on the ski binding 1 because resiliently elastic means or force storage systems can be adjusted with respect to their spring or biasing force. The ski binding 1 is not restricted to the design intended for a safety binding and instead it would also be possible to use rigid retaining elements for a sports shoe 2 with a generic ski binding 1, e.g. in the form of so-called strap bindings or similar.

In any event, the ski binding 1 is designed so that the user can couple his sports shoe 2 with the ski 3 when necessary and can then release this mechanical coupling connection when necessary.

The ski binding 1 comprises a front binding piece body 4 for retaining the front or toe-end portion of a sports shoe 2 and a rear binding piece body 5 for retaining the rear or heel-end portion of a sports shoe 2. These binding piece bodies 4, 5 comprise sole holders 6, 7 for the sole of a sports shoe 2 inserted in the ski binding 1 and optionally force storage systems or spring means for retaining the sole holder 6, 7 with a defined and optionally adjustable retaining force with respect to the ready or accommodating position of the sole holder 6, 7.

The binding piece bodies 4, 5 are accommodated or retained so that they can slide longitudinally in respective co-operating guide elements 8, 9 permanently secured to the ski. In particular, a guide track for the binding piece bodies 4, 5 extends through the guide elements 8, 9 parallel with the binding longitudinal direction—indicated by arrow 10—and parallel with the longitudinal direction of the ski 3. These guide elements 8, 9 permit relative displacements of the binding piece bodies 4, 5 in the binding longitudinal direction 10 but prevent shifting movements of the binding piece bodies 4, 5 in all directions extending transversely to the binding longitudinal direction 10.

Positioned between the front binding piece body 4 and rear binding piece body 5 is a positioning and fixing mechanism 11. This positioning and fixing mechanism 11 is provided as a means of setting and maintaining a desired distance between the binding pieces 12 needed for the respective sports shoe 3. The positioning and fixing mechanism 11 is retained so that it essentially unable to move relative to the binding longitudinal axis or binding longitudinal direction 10 and also in the direction perpendicular to the top face of the ski 3. In any event, the positioning and fixing mechanism 11 remains stationary when a change is being made to the distance between the binding pieces 12. The positioning and fixing mechanism 11 is basically provided as a means of enabling different binding piece distances 12 to be set and fixed as simply and rapidly as possible without errors in order to cater for the respective shoe sizes or sole lengths of sports shoes 2. The specified ski binding 1 with the central positioning and fixing mechanism 11 for the binding piece bodies 4, 5 is therefore specifically designed for businesses hiring out sports articles and skis 1.

A standing plane 13 for a sports shoe 2 retained in the ski binding 1 extends essentially parallel with the top face of the ski 3.

As may best be seen by comparing FIGS. 3 to 6, the generic ski binding 1 and its positioning and fixing mechanism 11 also has a first coupling element 14 connected to the front binding piece body 4 and a second coupling element 15 connected to the rear binding piece body 5. These coupling elements 14, 15 are preferably bar-shaped or strip-shaped or have some other profiled shape and have properties to enable them to withstand tensile and expansion forces which occur during use of the ski binding 1. Mutually facing and adjacent lying end portions 16, 17 of the coupling elements 14, 15 are used to position and retain the front and rear binding piece bodies 4, 5 in their guide elements 8, 9 in a tongue- like arrangement, starting from a central part-portion, in particular from the positioning and fixing mechanism 11, between the front and rear binding piece bodies 4, 5. The mutually facing end portions 16, 17 of the coupling elements 14, 15 therefore constitute integral parts and functionally relevant parts of the positioning and fixing mechanism 11. Above all, in order for the positioning and fixing mechanism 11 to function, it is necessary for the mutually facing end portions 16, 17 of the coupling elements 14, 15 to be such that they can be variably fixed relative to the positioning and fixing mechanism 11. In particular, the mutually facing end portions 16, 17 of the two coupling elements 14, 15 co-operate with the positioning and fixing mechanism 11 disposed between the binding piece bodies 4, 5 so that the position of the rear binding piece body 5 and/or the position of the front binding piece body 4 can be individually defined and fixed relative to the ski 3. This relative positioning of the two binding piece bodies 4, 5 with respect to the ski 2 or with respect to the guide elements 8, 9 takes place by changing an overlap width 18 between the mutually facing end portions 16, 17 of the two coupling elements 14, 15 and/or by changing the relative position of at least one of the coupling elements 14, 15 with respect to the stationary positioning and fixing mechanism 11 by reference to the binding longitudinal direction 10.

The coupling elements 14, 15 are therefore disposed in an overlapping arrangement in the region of the positioning and fixing mechanism 11. The bottom face of the second coupling element 15 preferably lies in the corresponding overlap zone on the top face of the first coupling element 14. The reverse arrangement would naturally also be possible. A duly selected or required overlap width 18 between the end portions 16, 17 of the two coupling elements 14, 15 therefore determines the respective distance between the binding pieces 12 and between the binding piece bodies 4, 5. In particular, the distance between the binding pieces 12 changes depending on the overlap width 18 so that the ski binding 1 can be individually adjusted or adapted to the respective shoe size or shoe sole length needed. Based on one advantageous embodiment, the coupling elements 14, 15 are slotted in a fork-type arrangement at their mutually facing end portions 16, 17 and are provided with a slot-shaped orifice extending through their longitudinal centre.

The mutually facing end portions 16, 17 of the coupling elements 14, 15 each have a plurality of positioning elements 19, 19', 20, 20' to enable the overlap width 18 to be changed in steps. An overlap of the coupling elements 14, 15 is chosen so that their end portions 16, 17 are disposed lying one above the other by reference to a vertical plane 21 extending in the binding longitudinal direction—arrow 10. The disposition and/or orientation of the positioning elements 19, 19', 20, 20' is selected so that the step widths or available stages in the overlap width 18 are able to cater for the existing sizes of a shoe size standard and the stages correspond to a standard length variation for shoe soles. Accordingly, the step stages which can be set on the positioning and fixing mechanism 11 with respect to the overlap width 18 correspond to the jumps in length of a standard shoe sole for a co-operating ski shoe or sports shoe 2. Alternatively, the adjustable step stages relative to the overlap width 18 may also constitute only a fraction of the smallest jump in size of standard shoe soles.

Each of the available step stages or step lengths for the overlap width 18 are therefore defined by the consecutive arrangement and an appropriate spacing between the positioning elements 19, 19', 20, 20'. A variability of the overlap width 18 in steps or stages is preferable to a stepless adjustability of the overlap width 18. In particular, if the step size and disposition structure of the positioning elements 19, 19', 20, 20' is chosen accordingly, inadmissible and detrimental intermediate positions or intermediate sizes with respect to the distance between the binding pieces 12 and with respect to the associated actual value of the respective sole length can be avoided. Conforming to the respective stages or jumps in distance with respect to the distance between the binding pieces 12 is what imparts safety and functional reliability to the ski binding 1, especially in the case of a safety ski binding.

The essential aspect is that the positioning elements 19, 19', 20, 20' are disposed on at least one side face 22, 23 respectively 22', 23' of the first coupling element 14 and also of the second coupling element 15 oriented essentially parallel with the vertical plane 21. The positioning elements 19, 20 respectively 19', 20' are disposed on the same or uniform side face 22, 23 respectively 22', 23', in particular each uniformly on the left-hand side face 22, 23 and/or on the right-hand side face 22', 23' of the two coupling elements 14, 15. The positions on the left-hand side and right-hand side are given by reference to the longitudinal mid-axis of the ski binding 1 or binding longitudinal direction 10, namely from the rear binding piece body 5 in the direction towards the front binding piece body 4.

By preference, a plurality of positioning elements 19, and 19', 20' is provided on two side flanks of the two coupling elements 14, 15, in particular on the left-hand side faces 22, 23 and on the right-hand side faces 22', 23' of the first and second coupling elements 14, 15. In other words, both longitudinally extending side faces 22, 22' of the first coupling element 14 and both longitudinally extending side faces 23, 23' of the second coupling element 15 are preferably each provided with a plurality of positioning elements 19, 19' respectively 20, 20'. These positioning elements 19, 20 and 19', 20' are preferably provided in the form of a plurality of tooth-type elements adjacent to one another in a row so that the end portions 16, 17 of the coupling elements 14, 15 are designed as double-sided or two-sided toothed racks, as may best be seen from FIG. 4. The coupling elements 14, 15 on the oppositely lying side faces 22, 22', 23, 23', each toothed and provided with co-operating positioning elements 19, 19', 20, 20', are therefore preferably oriented congruently or in axial alignment by reference to the binding longitudinal direction 10 and by reference to the binding longitudinal axis, as may best be seen from the plan views illustrated in FIGS. 1 and 5.

Figure 4:
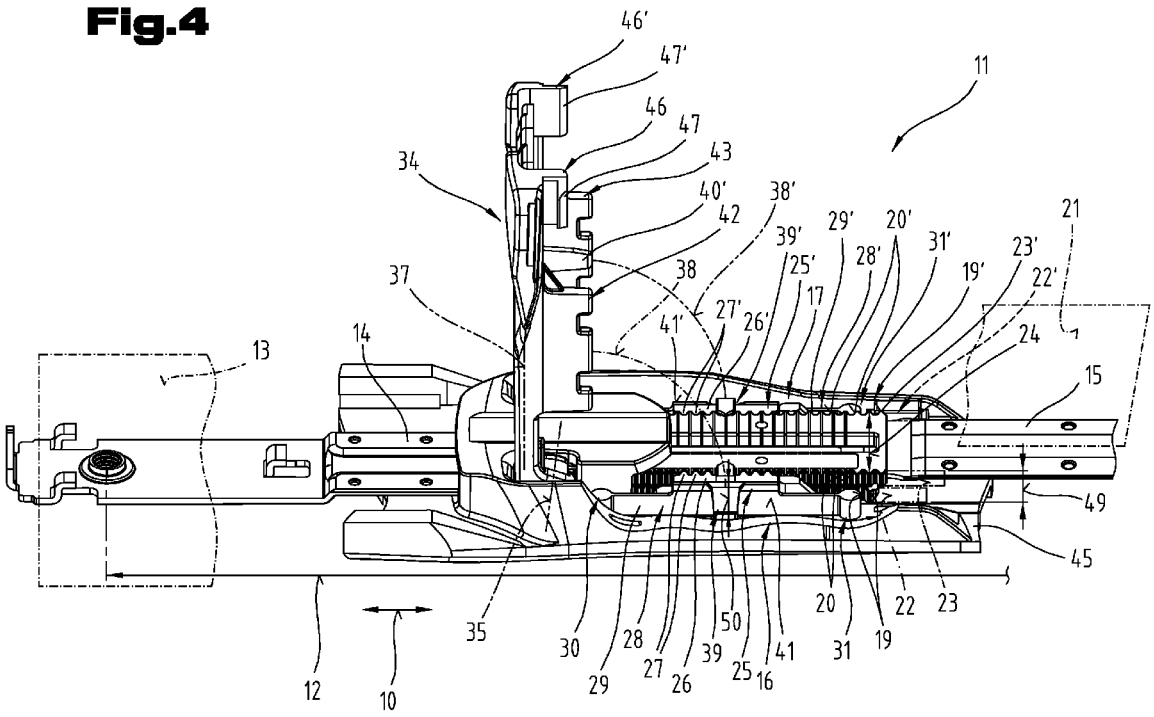
FIG. 4 shows the positioning and fixing mechanism illustrated in FIG. 3 once it has assumed the release or positioning mode.
Figure 5:
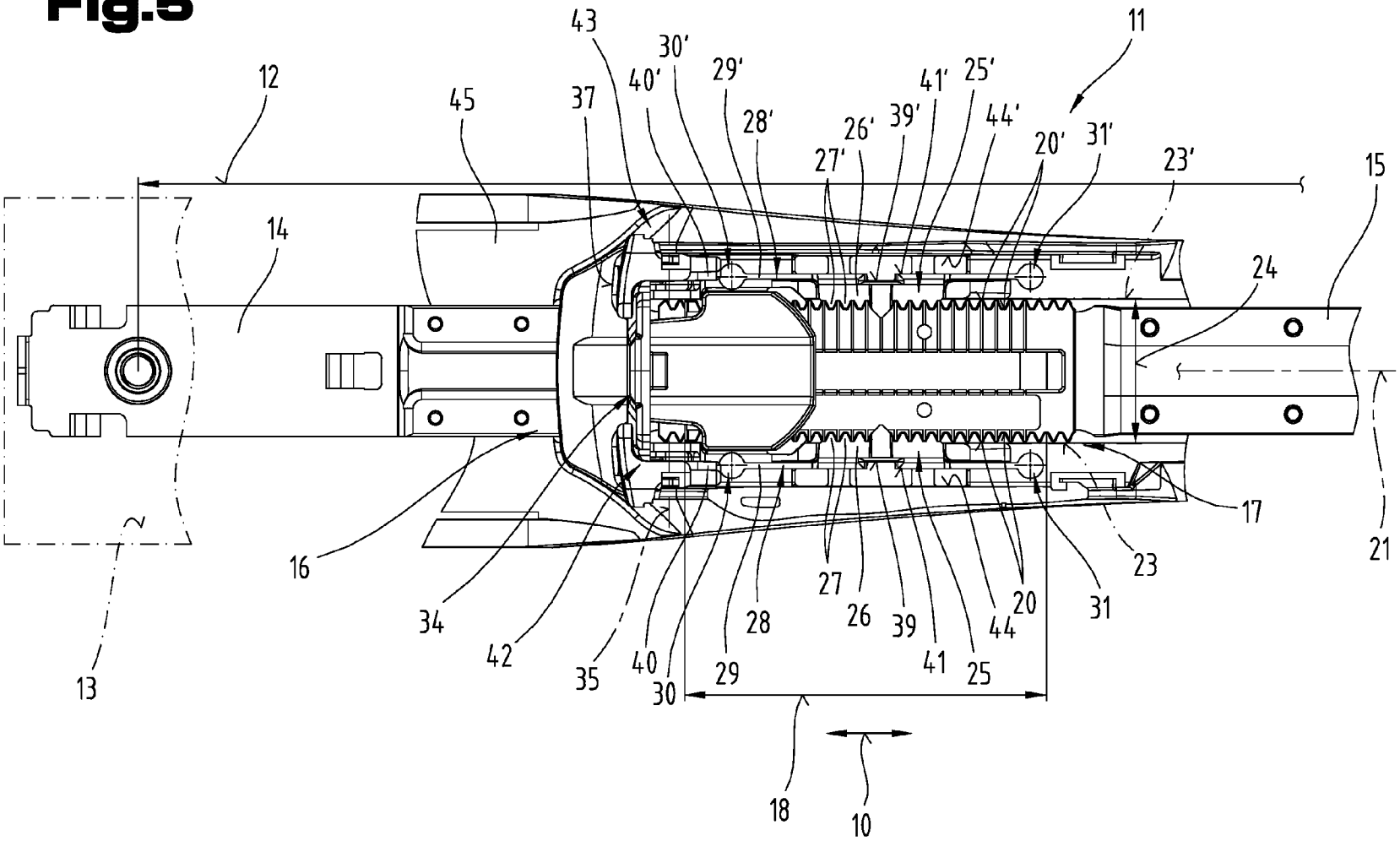
FIG. 5 is a plan view of the positioning and fixing mechanism illustrated in FIG. 4.

A width 24 of the end portions 16, 17 of the two coupling elements 14, 15 constituting the overlap extending transversely to the binding longitudinal direction 10 and essentially parallel with the standing plane 13 is preferably identical, as may best be seen from FIG. 5. In one advantageous embodiment, the mutually overlapping end portions 16, 17 are therefore each of the same width 24 within the resultant overlap region. Furthermore, the shape or size or the degree of stepping of the expediently tooth-like positioning elements 19, 19' on the first coupling element 14 is preferably identical to the likewise expediently tooth-like positioning elements 20, 20' of the second coupling element 15, as illustrated in FIG. 4. Alternatively, it would also be possible to opt for a pitch or step amount between the bottom positioning elements 19, 19' as it were, relative to the upper or top positioning elements 20, 20', and vice versa, that is a whole number multiple, in particular as a double or quadruple step amount.

The other essential aspect is that the first and second coupling element 14, 15 can be coupled with or connected to one another by means of at least one lock element 25, 25' mounted so as to be displaceable essentially at a right angle to the vertical plane 21 and uncoupled from one another or disconnected from one another when it is necessary to change the distance between the binding pieces 12. In other words, by means of this at least one lock element 25, 25' mounted so as to be displaceable essentially at a right angle to the vertical plane 21, a connection can be established between the overlapping coupling elements 14, 15, preferably lying one above the other, as and when necessary.

Another essential aspect is that at least one lock element 25, 25' with at least one positioning element 19, 19', 20, 20', but preferably with several positioning elements 19, 20 respectively 19', 20' disposed immediately one after the other, of both the first and second coupling elements 14, 15 can be selectively moved into a mutual positive engagement, or can be moved out of engagement by the positioning elements 19, 20 respectively 19', 20' disposed on at least one side flank. In other words, at least one lock element 25, 25' is provided which acts as a bridging element which can be activated and deactivated as and when necessary and couples the two coupling elements 14, 15 with one another so that either a mutual relative displacement in the binding longitudinal direction 10 is prevented between the two coupling elements 14, 15—FIG. 3—or a relative displacement between the two coupling elements 14, 15 in the binding longitudinal direction 10 is permitted—FIG. 4.

It is preferable if two oppositely lying flanks or side faces 22, 23 and 22', 23' of the two coupling elements 14, 15 respectively co-operate with a lock element 25 and 25' mounted so as to be displaceable essentially at a right angle to the vertical plane 21. By opting for a symmetrical arrangement of at least two lock elements 25, 25' on either side of the longitudinal mid-axis of the ski binding 1, the retaining or blocking force of the lock elements 25, 25' or positioning and fixing mechanism 11 can be significantly increased.

The at least one lock element 25, 25' is expediently provided in the form of at least one toothed bar 26, 26' with a plurality of teeth 27, 27' disposed one after the other in the binding longitudinal direction 10. This at least one toothed bar 26, 26' or its toothed arrangement is disposed so that it complements or is congruent with the positioning elements 19, 19' of the first coupling element 14 and the positioning elements 20, 20' of the second coupling elements 15 as viewed from above so that the at least one lock element 25, 25' can be moved into engagement, positively connecting these positioning elements 19, 19', 20, 20'. In other words, a lock element 25, 25' disposed in its locking position or locked position can be forced or pushed towards the respective side face 22, 23 respectively 22', 23' of the two coupling elements lying one above the other 14, 15, thereby positively connecting the two coupling elements lying one above the other 14, 15 to one another via their side walls or side faces 22, 23 respectively 22', 23'. Accordingly, relative displacements between the two coupling elements 14, 15 with respect to the binding longitudinal direction 10 are prevented by activating a positive connection via the at least one laterally positioned lock element 25, 25', as is the case when the positioning and fixing mechanism 11 is in the operating state illustrated in FIG. 3.

Based on one advantageous embodiment, the at least one lock element 25, 25' is retained by means of a retaining spring 28, 28' mounted so that it can flex elastically and rebound elastically. The elastic retaining force of the retaining spring 28, 28' is oriented essentially perpendicular to the vertical plane 21. The lock element 25, 25', in particular its toothed bar 26, 26', is disposed on or attached to the retaining spring 28, 28' so that the retaining spring 28, 28' and toothed bar 26, 26' form a one-piece or integral component, as illustrated in FIG. 4. In the case of a first embodiment, the retaining spring 28, 28' is shaped in such a way and mounted on the positioning and fixing mechanism 11 in such a way that it holds the lock element 25, 25' out of engagement with the positioning elements 19, 20 respectively 19', 20' in its relaxed state. Alternatively, the retaining spring 28, 28' may be designed or positioned so that it forces the lock element 25, 25' by means of a resilient flexing action constantly and positively against the positioning elements 19, 20 respectively 19', 20', as illustrated in FIG. 4.

The retaining spring 28, 28' is preferably provided in the form of a leaf spring 29, 29'. This leaf spring 29, 29' holds the lock element 25, 25' in a tongue or cantilever arrangement. Based on one advantageous embodiment illustrated in FIG. 4, lock element 25, 25' or its toothed bar 26, 26' is disposed approximately in the middle portion of an arcuately deformable leaf spring 29, 29' mounted at its distal end so that it can move or pivot. The leaf spring 29, 29' is preferably mounted via pivot bearings 30, 31, 30', 31' forming pivot axes perpendicular to the standing plane 13, so that they can be at least pivoted and preferably also moved in translation to a certain extent. This offers a robust and functionally reliable way of enabling the at least one lock element 25, 25' to be moved laterally towards or away from the side faces 22, 23 respectively 22', 23' of the two coupling elements 14, 15.

Figure 6:
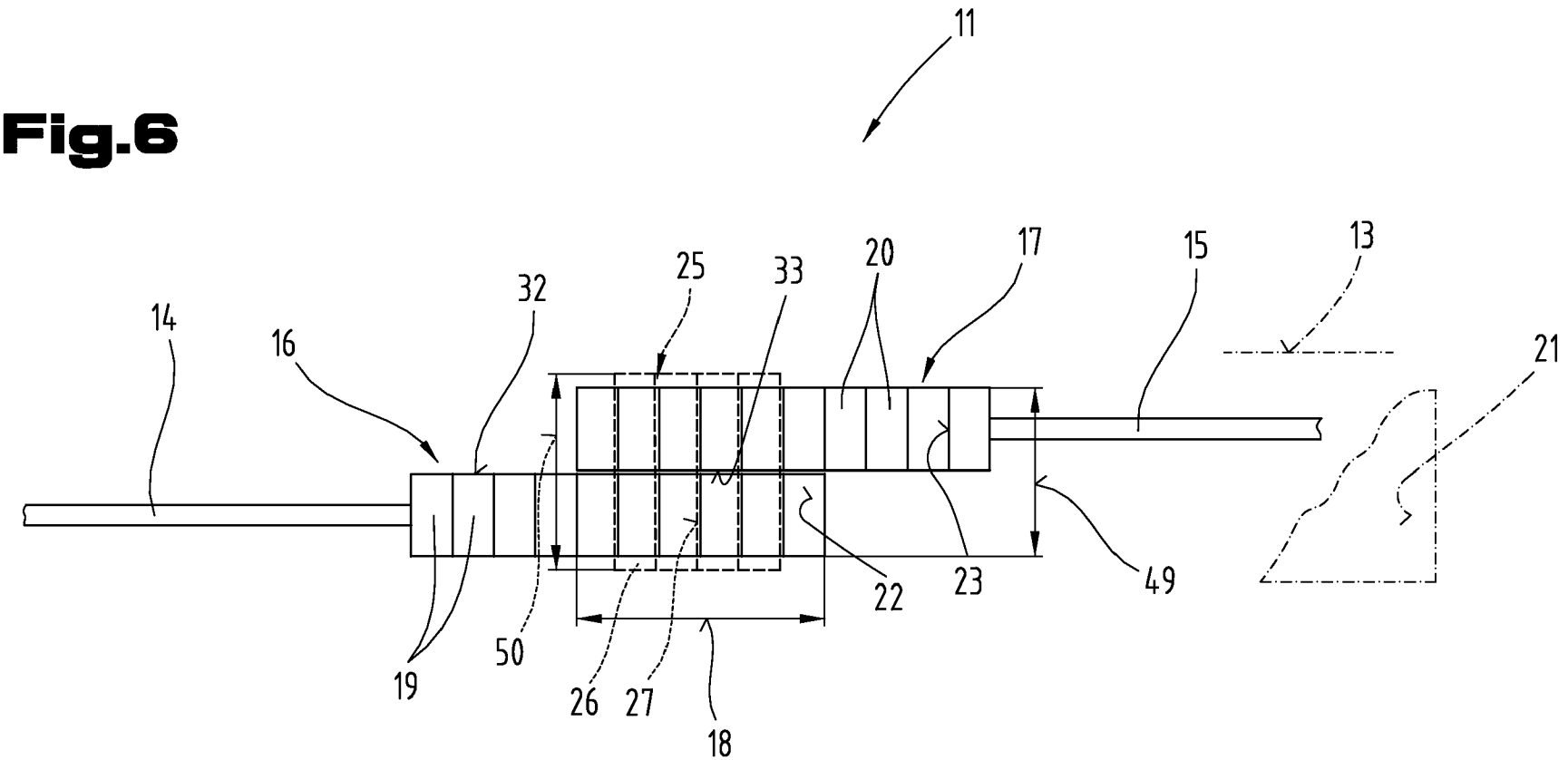
FIG. 6 is a highly schematic side view of the mutually overlapping coupling elements of the positioning and fixing mechanism.

It is also of practical advantage if the mutually facing flat faces 32, 33 of the first and second coupling elements 14, 15 oriented essentially parallel with a standing plane 13 for a sports shoe 2 are of a flat or smooth design. In other words, the mutually adjacent or mutually co-operating top and bottom flat faces 32, 33 of the first and second coupling elements 14, 15 do not have any toothing, in particular are of a toothless design, in which case the mutually co-operating flat faces 32, 33, which preferably lie directly one against the other, are able to act as complementary sliding surfaces, at least within their maximum overlap width 18. At the complementary contact points or at the two contact surfaces between the overlapping coupling elements 14, 15 lying one above the other, mutual friction is therefore kept as low as possible because no toothing is provided between the complementary contact surfaces, as schematically illustrated in FIG. 6. This enables the binding piece elements 4, 5 to be adjusted with ease and by as comfortable as possible a manipulation in order to set the requisite distance between the binding pieces 12.

In order to activate the binding piece bodies 4, 5 so that they can move relative to the guide elements 8, 9 and fix the respective relative positions of the binding piece bodies 4, 5, the positioning and fixing mechanism 11 has a pivotably mounted operating or lock lever 34. This lock lever 34 must be manually operated in order to switch the positioning and fixing mechanism 11 into either a positioning mode in which a relative displacement is possible between the binding piece bodies 4, 5 or into the fixing mode in which the binding piece bodies 4, 5 are retained via the coupling elements 14, 15 in the respective desired relative position or at the desired distance between the binding pieces 12.

The lock lever 34 is preferably mounted so that it is able to pivot about an axis 35 extending transversely to the binding longitudinal direction 10 and essentially parallel with a standing plane 13 for a sports shoe 2. When the positioning and fixing mechanism 11 is in the fixing position 36 illustrated in FIG. 3, the lock lever 34 assumes an orientation extending essentially parallel with the standing plane 13. In this fixing position 36 illustrated in FIG. 3, the binding piece bodies 4, 5 are retained via the coupling elements 14, 15 with the respective desired distance between the binding pieces 12. When the lock lever 34 assumes an upwardly pivoted position in which the lock lever 34 is inclined by between 10° and 150° with respect to the standing plane 13, the lock lever 34 is in the positioning mode 37 in which the binding piece bodies 4, 5 are able to slide freely in the longitudinal direction. This ability of the binding piece bodies 4, 5 to move is defined by essentially only the longitudinal extension of the guide elements 8, 9 and essentially only by the desired or requisite amount of displacement for the binding piece bodies 4, 5.

Having assumed the orientation extending essentially parallel with the standing plane 13, i.e. having assumed the fixing position 36, the lock lever 34 forces the at least one lock element 25, 25' firmly against the co-operating side face 22, 23 respectively 22', 23' of the first and second coupling elements 14, 15. The lock lever 34 is therefore designed so that it enables or causes a selective activation and deactivation of a positive connection between the at least one lock element 25, 25' and the two respective adjacently lying side faces 22, 23 respectively 22', 23' of the two coupling elements 14, 15 disposed one above the other.

The left-hand side face 22, 23 and the right-hand side face 22', 23' of the two strip-shaped coupling elements 14, 15 lying directly one above the other preferably each co-operate with a lock element 25, 25', as may be seen from FIGS. 4 and 5. The locking function of the two lock elements 25, 25' is preferably activated and deactivated by means of a single lock lever 34. When the lock lever 34 has assumed the fixing position 36—FIG. 3—the two lock elements 25, 25' are forced essentially simultaneously against the coupling elements 14, 15 so as to engage with the coupling elements 14, 15, and any deviating movement of the lock elements 25, 25' from the coupling elements 14, 15 is prevented by the lock lever 34, in particular by its leg portions 42, 43. Conversely, once the lock lever 34 has assumed the positioning mode 37—FIGS. 4, 5—the two laterally disposed lock elements 25, 25' can be spaced apart from the coupling elements 14, 15, thereby permitting the relative movement between the coupling elements 14, 15.

Based on one advantageous embodiment, the lock lever 34 is designed so that having assumed its fixing position 36, it establishes at least one positive connection 38, 38' with the at least one lock element 25, 25'. Based on another advantageous embodiment illustrated in FIG. 4, the lock lever 34 establishes a dovetail connection with the at least one lock element 25, 25' when it is in the downwardly folded fixing position 36 illustrated in FIG. 3. Instead of using a dovetail connection, it would naturally also be possible to use a groove-spring connection to prevent relative movements between the at least one lock element 25, 25' and lock lever 34 in the binding longitudinal direction 10. In particular, relative movements of the at least one lock element 25, 25', which is preferably mounted so that it can be displaced by an elastically flexible retaining spring 28, 28', are reliably prevented in the binding longitudinal direction 10 when the lock lever 34 assumes its downwardly folded fixing position 36. In particular, due to this at least one positive connection 38, 38', the forces acting on the lock element 25, 25' in the direction of the binding longitudinal axis 10 are transmitted directly to the lock lever 34 and reliably absorbed by it. The elastic retaining system of the lock elements 25, 25' via the retaining springs 28, 28' would not be sufficient on its own to absorb the sliding forces of the binding piece bodies 4, 5 occurring in the binding longitudinal direction 10 during use of the ski binding 1. In particular, the binding piece bodies 4, 5 act via the coupling elements 14, 15 on the positioning and fixing mechanism 11 and ultimately on the at least one lock element 25, 25' in such a way that there is a tendency to slide in the binding longitudinal direction 10. Due to the positive connection 38, 38' described above, a sufficiently strong fixing is obtained in the direction of the binding longitudinal axis 10 as soon as the lock lever 34 assumes its downwardly pivoted fixing position 36 in spite of the fact that a lock element 25, 25' is used which has at least one retaining or leaf spring 28, 28' respectively 29, 29' which is mounted on the positioning and fixing mechanism 11 in a seemingly relatively flimsy manner—to permit lateral movements.

The positive connection 38, 38' is preferably defined by at least one groove 39, 39' extending at least approximately perpendicular to the standing plane 13, which moves into a positive engagement with at least one co-operating raised area 40, 40' on the lock lever 34 as soon as the lock lever 34 assumes its downwardly folded fixing position 36. Naturally, it would also be possible to opt for a reverse arrangement of the elements establishing the positive connection in order to obtain a positive connection 38, 38'. In particular, at least one bar-shaped or bead-type raised area may be provided on at least one lock element 25, 25', which can co-operate in a positive fit with a groove-type recess on the lock lever 34. The respective positive connection 38, 38' between the at least one lock element 25, 25' and the lock lever 34 is preferably disposed on the external face 41, 41' of the at least one lock element 25, 25' facing away from the coupling elements 14, 15.

Based on one advantageous embodiment, the lock lever 34 is of an essentially U-shaped or C-shaped cross-section in at least certain portions, as illustrated by way of example in FIG. 4. Its lateral leg portions 42, 43 are oriented essentially parallel with a vertical plane 21 extending in the binding longitudinal direction 10. These leg portions 42, 43 are used amongst other things to obtain the positive connection 38, 38' with the at least one lock element 25, 25'. In particular, these leg portions 42, 43 may establish a positive connection 38, 38' as soon as the lock lever 34 is in its fixing position 36. In the embodiment illustrated, the leg portions 42, 43 form a plate-type support element for strip-shaped raised areas 40, 40', which may establish a connection with grooves 39, 39' or with some other groove-type recesses or alternatively with co-operating bores in the lock elements 25, 25'.

As best illustrated in FIG. 5, the lock lever 34 of one advantageous embodiment may be designed so that its leg portions 42, 43 positively locate in at least one co-operating orifice 44, 44' or in at least one co-operating cut-out in a base plate of the positioning and fixing mechanism 11 on assuming the fixing position 36. This positive connection is also designed so that when the lock lever 34 is in its fixing position 36, the longitudinal forces extending parallel with the binding longitudinal direction 10 are transmitted via the coupling elements 14, 15 to the at least one lock element 25, 25' and ultimately to the lock lever 34, and can be absorbed by the lock lever 34 or its leg portions 42, 43 reliably and affording sufficient stability.

It is also of practical advantage if the lock lever 34 is retained in its fixing position 36 by means of at least one snap-fit connection 46, 46' comprising at least one elastically flexible coupling element 47, 47', in particular is secured to prevent any inadvertent movement. This snap-fit connection 46, 46' expends a retaining force which can be overcome by hand, in particular without tools, to enable the lock lever 34 to be moved from the fixing position 36 into the release or positioning mode 37—and vice versa—as and when required. Based on one advantageous embodiment, the snap-fit connection 46, 46' and its coupling element 47, 47' is provided in the form of at least one slot 48, 48' or by some other means of reducing stiffness in the end portion of the lock lever 34 facing away from the axis 35. In particular, wing-type coupling elements 47, 47' may be provided, which can be disengaged from the base plate of the positioning and fixing mechanism 11 by manually applying sufficient pressure or force for the lock lever 34 to be pivoted upwards into its release or positioning mode 37 by a relatively light movement.

As may best be seen from FIG. 4 and a comparison of FIGS. 4 and 6, a height 49 of the two coupling elements 14, 15 extending at least one above the other or lying directly one above the other measured essentially perpendicular to the standing plane 13 is the same as a vertical extension 50 of the at least one but preferably two lock elements 25, 25' measured in an essentially identical or parallel orientation. In particular, a height 49 of the coupling elements 14, 15, preferably lying one above the other, within their maximum or defined overlap width 18 extends in an approximately vertical extension 50 of the at least one lock element 25, 25' and its toothed bar 26, 26', which is able to act effectively with respect to the coupling elements 14, 15 and positively connect these coupling elements 14, 15 from at least one side face 22, 23 respectively 22', 23'. This results in a robust and at the same time reliably operating coupling and uncoupling between the coupling elements 14, 15.

The embodiments illustrated as examples represent possible variants of the ski binding 1 and its positioning and fixing mechanism 11, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention For the sake of good order, finally, it should be pointed out that, in order to provide a clearer understanding of the structure of the ski binding 1 and positioning and fixing mechanism 11, they and their constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3-6 constitute independent solutions proposed by the invention in their own right. The objectives and associated solutions proposed by the invention may be found in the detailed descriptions of these drawings.

The invention claimed is:

1. A Ski binding with guide elements oriented in the binding longitudinal direction for a front and a rear binding piece body which can be pre-fitted or fitted on a ski, which binding piece bodies are designed to retain the front respectively rear end portion of a sports shoe within an substantially horizontally oriented standing plane, comprising a first coupling element connected to the front binding piece body and a second coupling element connected to the rear binding piece body, and mutually facing end portions of these coupling elements co-operate with a positioning and fixing mechanism disposed between the binding piece bodies for adjusting and retaining the binding piece bodies by reference to the binding longitudinal direction as and when necessary, and the mutually facing end portions of the coupling elements are disposed in an overlapping arrangement one above the other by reference to a vertical plane extending in the binding longitudinal direction, and an overlap width between the two coupling elements is variable to enable an individual adjustment of different binding piece distances, and the mutually overlapping end portions of the coupling elements respectively have a plurality of positioning elements for changing the overlap width in steps, wherein the positioning elements of the first and second coupling elements are disposed on the left-hand and/or right-hand side faces of the two coupling elements lying one above the other by reference to the standing plane and binding longitudinal direction, and the first and second coupling element can be selectively rigidly coupled with one another and uncoupled from one another by means of at least one lock element mounted so as to be displaceable substantially at a right angle to the vertical plane, and the at least one lock element can be moved into a mutual connecting engagement or out of engagement with both the positioning elements of the first coupling element and the positioning elements of the second coupling element.

2. The ski binding as claimed in claim 1, wherein a plurality of positioning elements is disposed respectively on two oppositely lying side faces of the first and second coupling elements, and a lock element mounted so as to be displaceable substantially at a right angle to the vertical plane co-operates respectively with the oppositely lying side faces.

3. The ski binding as claimed in claim 1, wherein at least one lock element is provided in the form of a toothed bar with a plurality of teeth disposed one after the other in the binding longitudinal direction, which can be moved into engagement with positioning elements of both the first and the second coupling element.

4. The ski binding as claimed in claim 1, wherein at least one lock element is retained so as to be resiliently displaceable by means of a retaining spring and the retaining spring holds the lock element out of engagement with the positioning elements on the two coupling elements in its relaxed state, or the retaining spring holds the at least one lock element in a resiliently flexible engagement with the positioning elements of the two coupling elements.

5. The ski binding as claimed in claim 4, wherein the retaining spring is provided in the form of a leaf spring and retains the lock element in a tongue-type arrangement, or the lock element is disposed approximately in the middle portion of an arcuately deformable leaf spring articulatingly linked to its distal ends.

6. The ski binding as claimed in claim 1, wherein the mutually facing flat faces of the first and second coupling elements oriented substantially parallel with a standing plane for a sports shoe are of a flat or smooth design, in particular of a toothless design, so that the mutually co-operating flat faces form complementary sliding surfaces.

7. The ski binding as claimed in claim 1, wherein a lock lever is provided, which is mounted so that it can pivot about an axis extending transversely to the binding longitudinal direction and substantially parallel with the standing plane for a sports shoe, and which forces the at least one lock element against the side faces of the first and second coupling element on assuming an orientation extending substantially parallel with the standing plane, and a positive connection is established between the two coupling elements via this at least one lock element.

8. The ski binding as claimed in claim 1, wherein a lock lever is provided, which establishes at least one positive connection to the at least one lock element, in particular in the manner of a dovetail connection or a groove-spring connection to prevent relative movements between the at least one lock element and the lock lever by reference to the binding longitudinal direction on assuming its fixing position.

9. The ski binding as claimed in claim 8, wherein at least one groove or raised area extending at least approximately perpendicular to the standing plane is provided on the external face of the at least one lock element facing away from the coupling elements, which moves into a positive engagement with at least one co-operating raised area or groove on the lock lever as soon as the lock lever assumes its downwardly folded fixing position.

10. The ski binding as claimed in claim 8, wherein the lock lever is substantially U-shaped or C-shaped in certain portions as viewed in cross-section and its lateral leg portions are oriented substantially parallel with a vertical plane extending in the binding longitudinal direction.

11. The ski binding as claimed in claim 10, wherein, on assuming its fixing position, the leg portions of the lock lever positively locate in at least one co-operating orifice or in at least one co-operating cut-out in a base plate of the positioning and fixing mechanism.

12. The ski binding as claimed in claim 8, wherein the lock lever is retained in its fixing position by means of a snap-fit connection comprising at least one elastically flexible coupling element with a retaining force which can be overcome by hand.

13. The ski binding as claimed in claim 12, wherein the coupling element of the snap-fit connection is provided in the form of at least one slot or a reduction in stiffness in the end portion of the lock lever facing away from the axis.

* * * * *